US005534313A

United States Patent [19]

Kung et al.

[11] Patent Number: 5,534,313

[45] Date of Patent: Jul. 9, 1996

[54] INDUCTION HEATING OF DIFFUSION COATINGS

[75] Inventors: Steven C. Kung; Richard A. Gleixner, both of North Canton, Ohio

[73] Assignee: The Babcock & Wilcox Company, New Orleans, La.

[21] Appl. No.: 406,346

[22] Filed: Mar. 1, 1995

[51] Int. Cl.[6] ..... B05D 5/06

[52] U.S. Cl. ..... 427/543; 427/374.1; 427/376.2; 427/376.3; 427/376.4; 427/376.6; 427/376.8; 427/383.7; 427/398.1; 427/436; 427/591

[58] Field of Search ..... 427/543, 591, 427/436, 398.1, 374.1, 376.2, 376.3, 376.4, 376.6, 376.8, 383.7

[56] References Cited

U.S. PATENT DOCUMENTS

| | | | |
|---|---|---|---|
| 4,031,274 | 6/1977 | Bessen | 427/229 |
| 4,040,870 | 8/1977 | Holzl | 148/6.3 |
| 4,087,589 | 5/1978 | Bessen | 428/596 |
| 4,153,483 | 5/1979 | Holzl | 148/31.5 |
| 5,089,200 | 2/1992 | Chapman, Jr. et al. | 264/127 |
| 5,364,659 | 11/1994 | Rapp et al. | 427/253 |

*Primary Examiner*—Bernard Pianalto
*Attorney, Agent, or Firm*—Daniel S. Kalka; Robert J. Edwards

[57] ABSTRACT

A chromium aluminum and/or silicon diffusion coating is applied to a high temperature substrate such as a boiler tube by induction heating at a predetermined frequency of a known coating preparation such as pack cementation of the coating on the substrate to provide an improved coating of predetermined thickness with increased corrosion resistance.

13 Claims, 1 Drawing Sheet

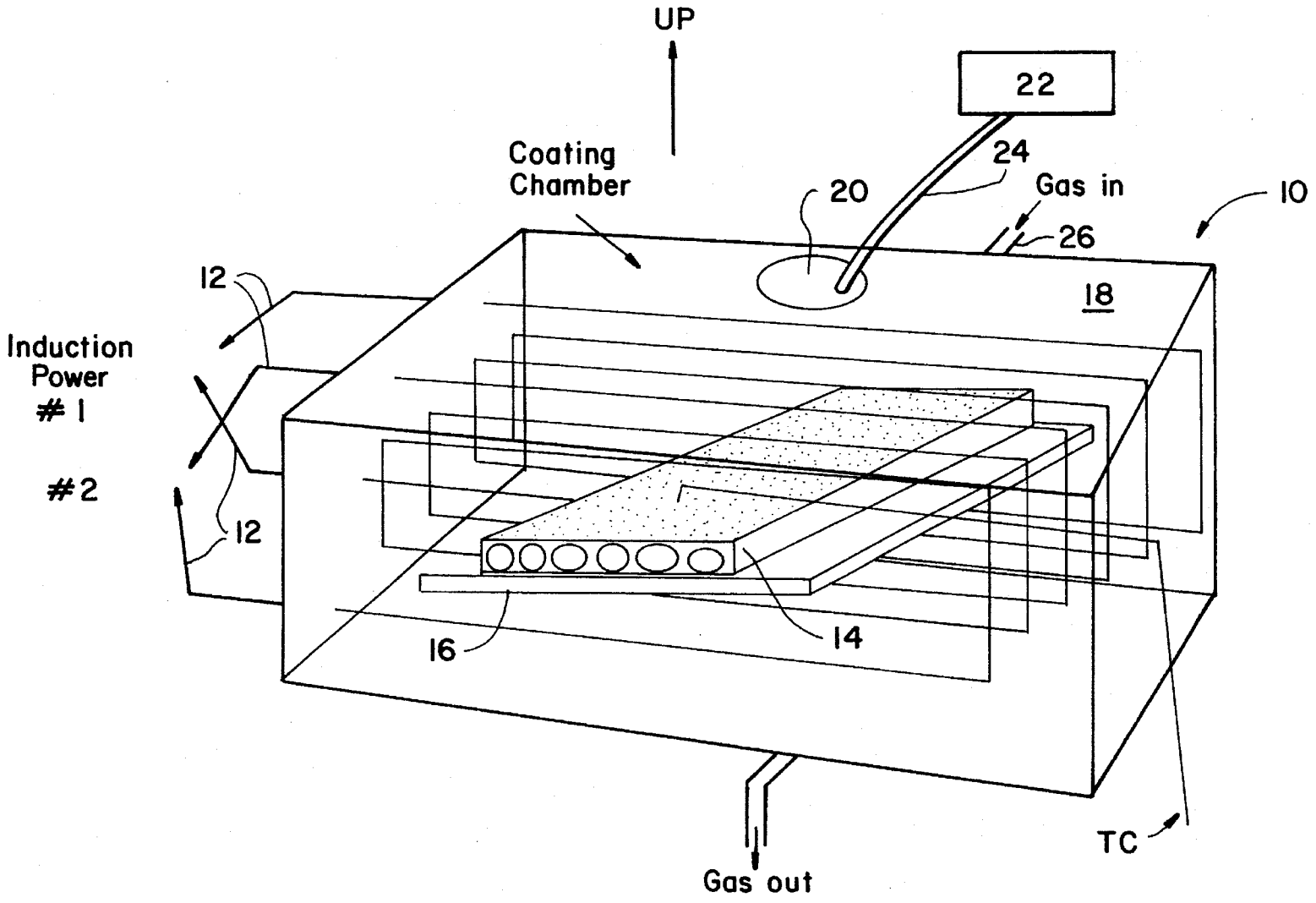
10
22
Gas in
26
24
18
20
UP
Coating Chamber
14
16
12
12
TC
Gas out
Induction Power
#1
#2

INDUCTION HEATING OF DIFFUSION COATINGS

BACKGROUND OF THE INVENTION

1. Field of the Invention

The present invention relates generally to diffusion coatings such as chromizing for corrosion resistance and particularly to the production of such coatings by induction heating same during the coating process.

2. Description of the Related Art

Diffusion coating are frequently applied on the surfaces of various high-temperature components to enhance their corrosion resistance. The coatings are achieved by diffusing reactive elements, such as Cr, Si, Al, and rare-earth elements, individually or simultaneously, into the component surface at elevated temperatures. Upon exposure to corrosive environments, these coatings can provide enhanced corrosion protection on the component surfaces by forming more protective oxides or improving the oxide integrities. Currently, three processing techniques are used: 1)pack cementation, 2)slurry, and 3)blanket processes.

A typical pack cementation process involves burying the parts to be coated with a pack mix in a retort. The pack mix consists of powders of a source metal or alloy (masteralloy), a small amount of halide salt (activator), and a large amount of inert oxide (filler). The retort is heated to the coating temperature in a furnace and held therein for an extended period of time. An inert cover gas is generally passed through the retort to maintain a reducing condition during the coating process. The retort is heated inside a high-temperature furnace which is either electric for laboratory and bench-scale productions or gas-fired for large-scale commercial productions.

Compared to pack cementation, the slurry and blanket processes require some modifications in the physical arrangement of the pack mix. In the slurry process, a layer of the pack mix is placed onto the surfaces of the substrates to be coated by water-base slurry spray or dipping; whereas in the blanket process, the mix is first accommodated in a ceramic fiber cloth via water-base slurry spray. The ceramic cloth is then dried and placed next to the substrate surfaces. Other than these modifications, the coating mechanisms involved in the slurry and blanket processes are identical to those in pack cementation.

All of these coating processes share a common drawback. The substrates are separated from the heat source of the electric or gas-fired furnace by a thick layer of ceramic powder filler or fiber cloth. The thermal conductivities of these ceramic materials are extremely low and therefore, they act as thermal insulators. As a result, the heating time required for raising the substrate temperature from room temperature to the coating temperature, as well as the cooling time from the coating temperature to room temperature, are significantly lengthy. The prolonged heating and cooling time attributes to excessive energy consumption, slow production rates, and unnecessary labor hours. As a result, the production cost for diffusion coatings is elevated.

SUMMARY OF THE INVENTION

The present invention solves the problems associated with prior art diffusion processes as well as other by induction heating diffusion coatings at elevated temperatures. Induction heating generates a heat source directly at the substrate surfaces to be coated, as well as the coating materials placed adjacent to the substrates, so long as they are electrically or magnetically conductive. The energy introduced by the induction heating is not affected by the existence of ceramic powder filler or ceramic cloth surrounding the substrates from the coating process. Because the heat is generated instantaneously at the substrate surfaces and on the source-metal (or masteralloy) particles, the energy required for initiating the coating mechanisms is immediately provided. As a result, the prolonged, energy consuming heat-up period and the slow cooling process is eliminated. Furthermore, depending upon the frequency of the induction power supply employed, the thickness at the substrate surfaces which is heated to the coating temperatures is easily controlled since the the thickness is directly proportional to the frequency of the power source.

Preparations of the coating system prior to the induction heating process is as follows. First, the source-metal (or masteralloy) powder containing the coating element(s) is thoroughly mixed with the activator and inert-filler powder at desired amounts. The pack mix is then used to cover the surfaces of substrates to be coated, as typically employed in the pack cementation process. In the slurry approach, the pack mix is applied to the substrate surfaces via water-base slurry spray or dipping. However, in the slurry process, the activator can be either mixed in the slurry with the source metal and inert filler, or applied as a separate layer on top of the source-metal/inert-filler mixture. Following the slurry application, the substrates are dried and then exposed to high temperatures. If the blanket process is chosen, the inert filler is no longer required as part of the pack mix. A water-base slurry containing the activator and source metal (or masteralloy) can be sprayed onto the ceramic fiber cloth, followed by drying the cloth, and placing the cloth adjacent to the substrate surfaces for high temperature treatment.

The assembled coating system is processed in a coating chamber equipped with one or multiple water-cooled induction coils. Depending upon the geometry of the substrates to be coated, the shapes of the induction coils can be circular, elliptical, square, or rectangular to achieve a uniform temperature distribution at the substrate surfaces.

In view of the foregoing it will be seen that one aspect of the present invention is to provide a method of diffusion coating which will shorten the heating time of substrates to reach coating temperatures.

Another aspect of the present invention is to provide a method of diffusion coating which will provide shorter substrate cooling times.

Yet another aspect of the present invention is to provide a method of diffusion coating wherein the thickness of the substrate surface heated is easily controlled.

These and other aspects of the present invention will be more fully understood upon a review of the following description of the preferred embodiment when considered in conjunction with the accompanying drawing.

BRIEF DESCRIPTION OF THE DRAWING

The drawing is a schematic of the equipment used to create the induction heated diffusion coating of the present invention.

DESCRIPTION OF THE PREFERRED EMBODIMENT

With particular reference to the figure it will be seen that the assembled coating system is processed in a coating chamber 10 equipped with multiple fluid-cooled induction coils 12, preferably a fluid like water. Depending upon the geometry of the substrates to be coated, the shapes of the induction coils 12 can be circular, elliptical, square, or rectangular to achieve a uniform temperature distribution at the surface of a substrate 14. The figure illustrates the coating of a flat substrate (e.g., a tube panel) in rectangular induction coils 12. This illustration arbitrarily includes two induction coils and therefore, two induction power supplies #1 and #2. The shaded area on top of the flat substrate 14 represents the arrangement of a coating system chosen from known pack cementation, slurry, or blanket process described earlier. The coating system and substrate 14 are then positioned on a plate 16 made of a non-electronically conductive ceramic material. Many high-temperature refractory materials commercially available are suitable for this plate 16. The induction coils 12 are powered by the power supplies #1 and #2 locate outside the chamber 10. Unlike the coating retort used in the traditional coating processes, the chamber 10 will not be exposed to high temperatures. Therefore, low-cost alloys, such as carbon steel, can be used as the chamber 10 material. The chamber 10 is fluid-cooled in a known manner to control the temperature during coating. Cooling is done through attached water-cooled tubing (not shown) located around the outer surface 18 of the chamber 10 and around the induction coils 12. As a result of the cooling, the dimension of the coating chamber 10 and its wall thickness may be significantly reduced. An observation window 20 may be incorporated as part of the coating chamber 10 to access the induction coils 12 and provide an area for other necessary penetrations into the chamber 10. The window 20 is properly sealed around any such penetrations when implemented.

The substrate 14 temperature is monitored by a pyrometer 22 focusing at the substrate 14 through the observation window 20 by way of a focusing device 24. Also thermocouples could be directly mounted to the substrate surfaces with leads sealably extending through the window 20. In comparison, the use of a thermocouple may be preferred because it can provide a much more reliable temperature reading, whereas pyrometers may be affected by the condensation of vapor species from the coating system to the observation window 20.

An inert gas is passed through inlet 20 into the coating chamber 10 before the start of the induction heating process so that a reducing coating environment is achieved. After the chamber 10 is fully flushed with the inert gas, the induction power source #1 and #2 are turned on and the inert gas flow continued. If the moisture level is high in the coating system (e.g., water absorbed by the pack mix), the substrate temperature is raised from room temperature to water boiling temperature preferably 250°–300° F. and held at this temperature for 10–20 minutes. Holding at this temperature will eliminate most of the residual water. After this treatment, the substrate temperature is increased to the desired coating temperature at a rapid heating rate within the capabilities of the induction power supplies #1 and #2. When a negligible amount of moisture is present, the holding procedure at 250°–300° F. is not used and the coating is heated directly to the coating temperature.

Whether the coating temperature is reached directly or after a delay, the coating system is held at the desired coating temperature for a predetermined duration when this temperature is reached. After the coating treatment is completed, the induction power is immediately shut off and the coating cooled. If a faster cooling rate is required the water flow rate in the cooling coils around the induction coils, as well as in the outer surface of the coating chamber 10 can be increased. A higher water flow rate can dissipate the heat from the substrate 19 surface more rapidly, and thus result in a faster cooling rate.

The preparation of the coating system prior to the induction heating process are similar to those involved in the pack cementation, slurry, and blanket processes discussed earlier. First, the source-metal or masteralloy powder containing the coating elements(s) is thoroughly mixed with the activator and inert-filler powder at desired amounts. The pack mix is then used to cover the surfaces of substrates to be coated, as typically employed in the pack cementation process. In the slurry approach, the pack mix is applied to the substrate surfaces via water-base slurry spray or dipping. However, in the slurry process, the activator can be either mixed in the slurry with the source metal and inert filler, or applied as a separate layer on top of the source-metal/inert-filler mixture. Following the slurry application, the substrates are dried and then exposed to high temperature. If the blanket process is chosen, the inert filler is no longer required as part of the pack mix. A water-base slurry containing the activator and source metal (or masteralloy) can be sprayed onto the ceramic fiber cloth, followed by drying the cloth, and placing the cloth adjacent to the substrate surfaces for high temperature treatment.

The use of the above described induction heating technique for diffusion coating provide the following advantages over those conducted in conventional electric and gas-fired furnaces.

1. The induction heating technique creates the heat source directly at the substrate surfaces. Therefore, the heating time for the substrates to reach the coating temperature can be significantly shortened.
2. The water-cooled induction coils surrounding the coating system, as well as the water-cooled chamber if so equipped, can facilitate the cooling of the substrate after the coating treatment. Therefore, the cooling time can be significantly reduced.
3. The thickness of the substrate surfaces heated to the coating temperature by the induction heating technique can be varied with the induction frequency. A higher frequency decreases the thickness of the heated zone, and vice versa. Therefore, the coating can be controlled to minimize the mechanical degradation in the substrate away from the surface regions.
4. Because the heat source of the induction technique is located at the substrate surfaces, only a small amount of the pack mix adjacent to the substrate surfaces is actually heated to the coating temperature and consumed during the coating. Therefore, the large amount of pack mix often employed in the pack cementation process can be either re-used for several coating runs, or the amount of pack mix can be significantly reduced.
5. Because of the coating system and induction coils are positioned inside the coating chamber, the chamber itself is not heated to the coating temperatures. Therefore, the materials requirement for the chamber construction is much less critical.
6. The size of the coating chamber and its wall thickness can be significantly reduced via proper cooling design. Therefore, the need for a large coating facility can be avoided.
7. Re-arrangement of the induction coils around the substrate surfaces is relatively simple compared to modifications of the heating mechanisms in conventional high-temperature furnaces. Therefore, localized coatings on selected substrate areas are more feasible in the induction heating method than the traditional coating processes.

8. It is possible to develop field-applied diffusion coating processes based on the technology of induction heating. For example, induction coils can be installed around the superheater tubes in boilers during outages and used to produce diffusion coatings in the field. As a result, the costly tube replacement can be minimized.

Although the induction heating technique eliminates the prolonged heating and cooling times inevitable in the traditional diffusion-coating processes, the technique is also applicable for other processes that require rapid heating and cooling rates, so long as the components to be treated are electrically or magnetically conductive. For example, the heating technique can be used to produce tungsten carbide fusible coatings and ceramic metallic coatings. The integrities of these coatings are greatly affected by the final heat-treatment procedures which demand rapid heating and cooling rates, as well as a precise control of exposure times at the peak temperatures.

Coatings are also frequently applied on the surfaces of high-temperature components to enhance their corrosion resistances. Among many commercially available coatings, The Babcock & Wilcox Company (B&W) has employed chromized diffusion coatings on heat exchanger tubes for many years to reduce the fireside and steamside corrosion in boilers. More recently, multi-element Cr/Al and Cr/Si co-diffusion coatings, originated by Ohio State University (OSU) were first commercially produced by B&W on waterwall panels. Such diffusion coatings can be applied to the substrate surfaces by using different processes, including the pack cementation, slurry, and blanket processes. A typical pack cementation treatment involves burying the parts to be coated with a pack mix in a retort. The pack mix consists of powders of a source metal or alloy (masteralloy), a small amount of halide salt (activator), and a large quantity of inert oxide (filler). The retort is heated to an elevated temperature in a furnace and held for an extended period of time. The furnace used is often electric for laboratory or bench-scale production, and gas-fired for commercial production. Details of the diffusion coating procedures and reaction kinetics are known and are not repeated here.

The slurry and blanket processes contain some modifications to the physical arrangement of the pack mix. In the slurry process, a layer of the pack mix is placed on the substrate surfaces through slurry spray; whereas in the blanket process, the mix is contained in a porous ceramic cloth wrapped around the substrates. However, the fundamental principles of these two modified processes are identical to those of pack cementation. Each of these coating methods possesses unique processing advantages and disadvantages, which are not discussed in this report.

Nevertheless, all of these coating processes share a common drawback, i.e., the substrates are separated from the heat source of the high-temperature furnaces by a thick layer of either ceramic oxide powder or ceramic cloth. The thermal conductivity of the oxide materials is extremely low and therefore, they act as thermal insulators. As a result, the heating time required for raising the coating system to the desired temperature (and cooling time for lowering it to room temperature) are significantly long. The prolonged heating and cooling times dictate unnecessary energy consumption and slow the production rate significantly.

It was found that heating with induction technique created a heat source directly at the surfaces of substrates and the coating materials adjacent to the substrate, so long as they are electrically or magnetically conductive. The energy introduced by the induction heating is not interfered by the existence of ceramic oxide particles and ceramic cloth surrounding the substrates. Because the heat is generated at the substrate surfaces (and the masteralloy particles), the energy that is required for initiating the coating mechanisms can be instantaneously provided. Consequently, the prolonged heating time can be eliminated. Furthermore, depending upon the frequency provided by the induction coil, the thickness of the substrate surfaces being heated can be controlled. This feature is very desirable because local heating at the surface can minimize the undersized degradation in mechanical properties due to over-heating of the substrate.

Tests were conducted to demonstrate the concept of induction heating a diffusion coating system capable of simultaneous chromizing and siliconizing using pack cementation. The pack mix required in the coating process enabling co-diffusion of Cr and Si was initially developed by Ohio State University. Using this pack mix an alloy composition of 18% Cr and 3% Si was achieved and the pack mix composition was used to produce the Cr/Si coating on a waterwall replacement panel. However, results of the production run indicated that the Ohio State University (OSU) coating was difficult to be reproduced in a commercial scale; a surface composition of only 13% Cr and ~1% Si was obtained. The Cr and Si concentrations achieved were not satisfactory compared to what were anticipated, i.e., 18% Cr and 3% Si.

Using the induction heating method described earlier with the pack mix composition and coating parameters given in Table 1

TABLE 1

Pack Composition and Coating Parameters

| Pack Mix Composition (in wt. %) | |
|---|---|
| 90Cr-10Si alloy powder | 23 |
| 95NAF-5NaCl activator powder | 3 |
| Si metal powder | 1 |
| $SiO_2$ inert filler | 73 |
| Coating Temperature | 2100° F. |
| Coating Time | 8 hours |
| Cover Gas | Ar |

a small induction furnace was assembled for this study. An induction power supply, Model T-2½-1 by Lepel Corp., was used to generate the needed induction field in a water-cooled copper coil. The furnace was powered by 220 VAC and the frequency was rated at 450 $KH_z$.

A Croloy ½ billet a registered trademark of The Babcock & Wilcox Company with a rectangular cross section (⅝"× ⅞") was chosen as the substrate to be coated. The nominal composition of Croloy ½, chemically equivalent to SA213-T2, is listed in Table 2. Samples, ~3" in length, were cut from the billet, followed by thoroughly sandblasting the surfaces to remove rust and contaminants. The sample was then buried in a 1¼" OD ×3½" alumina crucible (served as the coating retort) with the pack mix (see Table 1). The alumina crucible was then positioned in the center of the induction copper coil. The opening of the crucible was not sealed. An open system was needed to facilitate the temperature measurements during the coatings in this study. It should be pointed out that the amount of pack mix introduced to the crucible was quite small, because the sample itself occupied most of the inner volume of the alumina crucible.

TABLE 2

| Nominal Compositions of Croloy 2 ½ (in wt. %) | | | | | |
|---|---|---|---|---|---|
| C | Mn | S | P | Al | Si |
| 0.10 | 0.52 | 0.016 | 0.01 | 0.004 | 0.130 |
| Cr | Ni | Mo | Cu | Fe | |
| 0.72 | 0.06 | 0.48 | 0.07 | bal | |

The coating retort and induction coil were covered by a quartz jar equipped with gas inlet and outlet penetrations. The penetrations allowed argon cover gas to circulate through the system during coating. An inert atmosphere minimized the undesired high-temperature oxidation on the substrate surfaces and the masteralloy power particles.

Two temperature-monitoring techniques were used in the experiments. Initially, the coating temperature was measured using a hand-held pyrometer. Pyrometers are traditionally used in induction melting processes for temperature measurements. In this study, the temperature was monitored by focusing the pyrometer on the top surface of the sample through the quartz cylinder. The sample top surface was intentionally exposed above the pack mix. However, it was found that this technique tended to underestimate the metal temperatures. As a result, the substrate was often overheated and the grain size became enlarged.

The second technique involved using an Inconel-sheathed Type K thermocouple (1/16" OD) for the temperature measurements. A direct contact was established by welding the TC tip to the substrate surface inside the pack mix. The Inconel sheath eliminate the possibility of signal noise generated by the induction field. The results showed that this approach was much more reliable, and no over-heating and grain growth were experienced.

During the heat-up stage, the substrate surface could essentially be heated from room temperature to 2100° F. within a few minutes. However, because of the lack of operating experience in monitoring the induction power supply, the temperature was raised in several steps. Overall, the coating temperature was reached within an hour. It should be mentioned that, at the coating temperature, only the substrate surfaces and a very thin layer of pack mix (−⅛") immediately adjacent to the substrate surface were glowing. The majority of the pack mix away from the substrate surface did not. Therefore, in reality, only a very small amount of pack mix was fully heated to provide the needed coating reactions. This feature can be advantageous because the small consumption of the pack mix may enable it to become reusable for several coating treatments.

A coating layer of about 20 mils was formed on the substrate surface. The coating was uniform and contains no second-phase precipitates, embedded particles, and voids. EDX election diffraction X-ray analysis indicated that the coating was composed of 3% Si and 1% Cr. However, the morphology of the underlying alloy substrate reveals that over-heating has occurred as a result of poor temperature controlling. The extremely thick coating layer was also attributed to the excessive over-heating.

The poor temperature control was primarily caused by condensation of the activator vapors from the pack onto the inner surface of the quartz jar. The use of a pyrometer required viewing of the exposed, glowing top substrate surface through the quartz jar. Although the amount of condensation on the wall appeared to be insignificant, it must have been severe enough to interfere with the radiation from the substrate and consequently, resulted in substantial temperature differences.

A Type-K TC was attached to the surface of the substrate which eliminated the difficulties of temperature measurements during the coating treatments. A coating thickness of 11 mils was achieved on the substrate surface. Again, the coating layer was quite uniform and defect-free. EDX analysis revealed that the coating contained 5% Si and 2% Cr. In comparison, the Si concentration was much higher than what were accomplished by previous B&W and OSU studies, whereas the Cr concentration is much lower.

As mentioned before, a different coating composition was expected, because the coating mechanisms generated by the induction heating method can be quite different from those by conventional furnaces. The key difference is in the location of the heat sources. When the coating system is heated by induction, the substrate surface serves as the heat source. Consequently, the bulk of the substrate and the pack powder away from the substrate surface would be at lower temperatures. The existence of temperature gradients may significantly alter the diffusional fluxes of the vapor species formed in the pack, which govern the resulting coating composition and morphology. According to the findings of this study, the mechanistic changes resulting from the induction heating have strongly favored siliconizing and suppressed chromizing.

Table 1 indicates that a pre-melted 95NaF-5NaC1 was used as the activator in the pack mix. Based on thermodynamic calculations, NaF favors Si depositions, whereas NaC1 favors Cr. A large amount of NaF(i.e., at 95%) was needed in the activator for the previous B&W Cr/Si co-diffusion efforts in which conventional furnaces were used. Otherwise, siliconizing would not have been possible, and the coating would have become chromized only.

Results suggest that siliconizing is favored more than chromizing in the induction process. It is apparent that, to favor the chromizing in the induction heating process, the activator must be enriched with NaC1 and lean in NaF. Furthermore, because only a small amount of Si is needed (2–3%), NaC1 itself may accomplish the needed Si deposition along with chromizing. This means that a pure NaC1 may be used to assist both chromizing and siliconizing simultaneously in the co-diffusion pack. As a result, a pure NaC1 can replace the pre-melted 95NaF-5NaC1 in Table 1. Such a simplification in the activator composition can alleviate the preparation cost of a binary activator for the Cr/Si coating and significantly improve the reproducibility of coating composition and morphology.

Various coil shaped and sizes are available to accommodate the substrate geometries. For example, when coating is intended for a waterwall replacement panel, a rectangular or oval shape coil would be preferred in achieving a uniform temperature. A round coil is ideal for coating on a single tube. Furthermore, the thickness at the substrate surface which is heated by the induction power is controllable by varying the induction frequency. A higher frequency decreases the heated thickness at the substrate and vica versa.

Certain modifications and additions have been deleted herein for the sake of conciseness and readability but are fully intended to be within the scope of the following claims.

What is claimed is:

1. A method of applying a diffusion coating of a member selected from the group consisting of chromium, silicon, and aluminum to a substrate comprising the steps of:

preparing a coating on a substrate;

placing the coated substrate within a heating chamber having induction coils therein to have the coated substrate surrounded by the induction coils; and induction heating the coated substrate to provide a diffusion coating of a member selected from the group consisting of chromium, silicon, and aluminum on the substrate.

2. A method as set forth in claim 1 wherein the preparation of the coating is done according to a pack cementation process.

3. A method as set forth in claim 1 wherein the preparation of the coating is done according to a slurry process.

4. A method as set forth in claim 1 wherein the preparation of the coating is done according to a blanket process.

5. A method as set forth in claim 1 wherein the induction coils are formed according to the geometry of the coated substrate to surround the coated substrate thereby.

6. A method as set forth in claim 5 wherein the coated substrate is a rectangular plate and the induction coils are formed as a rectangle surrounding the plate.

7. A method as set forth in claim 1 further comprising the step of flushing the heating chamber with an inert gas prior to the induction heating of the coated substrate.

8. A method as set forth in claim 7 further comprising the step of induction heating of the coated substrate to a temperature in the range of 250°–300° F. and holding this temperature for a time period of approximately 10–20 minutes to eliminate any residual water in the coated substrate.

9. A method as set forth in claim 8 further comprising the step of heating the coated substrate to a desired coating temperature after the holding at 250°–300° F.

10. A method as set forth in claim 9 further comprising the step of holding the desired coating temperature for a predetermined time to provide the desired diffusion coating.

11. A method as set forth in claim 10 further comprising the step of cooling the coated substrate after holding at the desired coating temperature by passing cooling fluid through cooling coils located on the surface of the chamber and around the induction coils.

12. A method as set forth in claim 1 wherein the coated substrate is prepared by the pack cementation process.

13. A method as set forth in claim 1 wherein the induction heating is done at a predetermined freqeuncy to provide a desired thickness of coating on the substrate.

* * * * *

UNITED STATES PATENT AND TRADEMARK OFFICE

CERTIFICATE OF CORRECTION

PATENT NO. : 5,534,313

DATED : July 9, 1996

INVENTOR(S) : Steven C. Kung, et al

It is certified that error appears in the above-identified patent and that said Letters Patent is hereby corrected as shown below:

On title page,
In item 22 "March 1, 1995" is --March 17, 1995--.

Signed and Sealed this

Fifth Day of November, 1996

Bruce Lehman

*Attest:*

BRUCE LEHMAN

*Attesting Officer*

*Commissioner of Patents and Trademarks*